United States Patent [19]

Warburton, Jr.

[11] 4,291,087

[45] Sep. 22, 1981

[54] NON-WOVEN FABRICS BONDED BY RADIATION-CURABLE, HAZARD-FREE BINDERS

[75] Inventor: Charles E. Warburton, Jr., Ambler, Pa.

[73] Assignee: Rohm and Haas Company, Philadelphia, Pa.

[21] Appl. No.: 47,839

[22] Filed: Jun. 12, 1979

[51] Int. Cl.[3] ..... B05D 3/06; B32B 27/04; B32B 27/12; B32B 31/28; D04H 1/58

[52] U.S. Cl. ..... 428/288; 204/159.14; 427/44; 427/54.1; 427/375; 428/290

[58] Field of Search ..... 204/159.14; 427/44, 427/54, 54.1, 375; 428/288, 290

[56] References Cited

U.S. PATENT DOCUMENTS

| | | | |
|---|---|---|---|
| 2,931,749 | 4/1960 | Kine et al. | 428/290 |
| 3,121,070 | 2/1964 | Coover et al. | 525/198 |
| 3,156,581 | 11/1964 | Finnegan et al. | 428/288 |
| 3,214,492 | 10/1965 | Tocker | 204/159.16 |
| 3,554,788 | 1/1971 | Fechillas | 428/289 |
| 3,616,166 | 10/1971 | Kelley | 428/289 |
| 3,878,019 | 4/1975 | Chapman | 428/482 |
| 4,052,280 | 10/1977 | McGinnis | 428/913 |
| 4,148,987 | 4/1979 | Winey | 526/316 |

*Primary Examiner*—James C. Cannon

[57] ABSTRACT

Non-woven fabrics of fibers, at least 50% by weight of which are hydrophobic, impregnated with a water-insoluble binder of a polymer derived from a monomer mixture of at least one mono-ethylenically unsaturated monomer selected from the group of acrylic and methacrylic acids and ester and amide and nitrile derivatives thereof, vinyl aromatic compounds, vinyl and vinylidine halides, vinyl esters of saturated carboxylic acids, polymerizable ethylenically unsaturated carboxylic acids and esters thereof, alpha-olefins, and diene monomers are disclosed. Optionally, the binder can contain a photosensitive compound of either or both the polymerizable and non-polymerizable types. The polymers are sensitive to radiation, such as electron beam and ultraviolet radiation, and readily cure to a crosslinked condition upon exposure to such radiation. The cured non-woven fabrics have sufficient wet strength and wet abrasion resistance for a variety of uses, for example, use as a durable or permanent fabric for covering mattresses and use as a non-durable or disposable fabric as is used in disposable diapers.

12 Claims, No Drawings

NON-WOVEN FABRICS BONDED BY RADIATION-CURABLE, HAZARD-FREE BINDERS

BACKGROUND OF THE INVENTION

1. Field of the Invention

This invention relates to bonded non-woven fabrics and, more particularly, to a process for producing bonded non-woven fabrics. The bonded non-woven fabrics are useful in the production of articles of either flat or three-dimensional shape, including durable or permanent non-woven fabrics and non-durable or disposable non-woven fabrics. Examples of durable non-woven fabrics include those which are useful in producing home furnishings and furniture upholstery, such as placemats, tablecloths, bedspring covers, mattress covers, and drapery headers; those which are useful in producing automotive interiors; surgical garments and inner-linings of clothing garments; and other uses such as clothing tags, flags and banners, wall coverings, dust filter bags, and electrical insulation. Examples of non-durable fabrics include those which are useful in producing disposable diaper covercloths, wet-wipes, sheets, sanitary napkins, surgical dressings, and hospital draperies; and disposable specialty garments such as surgical gowns and hospital gowns.

2. Description of the Prior Art

As part of the increasing attention being given to health and environmental and industrial working conditions, greater attention is being paid to the components of sanitary and health care fabric products such as diapers, sanitary napkins, hospital drapes, disposable sheets and bed pans, and to the components of home furnishing, automotive, and clothing garment products with which persons come into contact. Non-woven fabrics for these applications are required to have an adequate tensile strength and abrasion resistance when wetted by water or aqueous systems such as body fluids (e.g. perspiration, etc.) and laundering systems. Generally the binders in current use for non-woven webs are crosslinked in order to obtain an adequate level of strength and abrasion resistance of the water-wet fabric. The crosslinking is normally based on formaldehyde, usually in the form of methylolated acrylamide although aminoplast crosslinkers are also used. Such systems are disclosed in the following two patents.

In U.S. Pat. No. 2,931,749, Kine et al. disclose non-woven fabrics of fibers bonded by a water-insoluble emulsion copolymer containing units of a compound from the group of acrylic acid, methacrylic acid, itaconic acid, and salts thereof with at least one $C_1$ to $C_{12}$ alkyl ester of acrylic and methacrylic acid, the copolymer being crosslinked to an insoluble condition by exposure to heat.

In U.S. Pat. No. 3,157,562, Kine et al. disclose, as a coating or impregnating composition, an aqueous dispersion of a water-insoluble linear addition polymer of N-methylolamide of (meth)acrylic acid, (meth)acrylamide, and at least one member of the group of acrylonitrile, styrene, vinyl toluene, vinyl acetate and $C_1$–$C_{18}$ alkyl (meth)acrylates. Also, a non-woven fabric of fibrous material and a water-insoluble linear addition copolymer containing the N-methylolamide of (meth)acrylic and (meth)acrylamide, and a process for making the same, are disclosed.

Formaldehyde is known to be a skin irritant. There is recent evidence that it is mutagenic (W. D. N. Kaplan, *Science*, 108, 43 (1948)) and concern has also been expressed that it may be found to be carcinogenic. For similar reasons, other relatively hazardous components in addition to those which evolve formaldehyde (e.g., N-methylol acrylamide), such as acrylamide and acrylonitrile, are also to be avoided in the manufacture of polymers for use as binders for non-woven fabrics intended for the uses described herein and related uses.

Non-crosslinking systems have been taught as binders for non-woven fabrics for certain specialty applications. In U.S. Pat. No. 3,554,788, Fechillas discloses a water-sensitive disposable, i.e., dispersible in water and flushable in home water closets, fabric for similar sanitary and health product uses. The binder of the patent comprises from about 70 to 90% of a water-insoluble, substantially water-insensitive, film-forming, non-self-crosslinking polymer and about 10 to 30% of a water-soluble polymer. The water-soluble polymers are described as water-sensitive binders such as hydroxyethyl cellulose, carboxymethyl cellulose, natural gums such as guar and preferably the alginates, such as sodium alginate, having a psuedo-plastic flow properties.

In U.S. Pat. No. 3,616,166, Kelley discloses a non-woven fabric bonded by a blend of a linear polymer of ethyl acrylate having a minimum film temperature not above room temperature and a viscosity average molecular weight of about 150,000 to 300,000 and a hard polymer having a minimum film temperature of at least about 50° C. in the ratio of 60 to 90% of the former and 40 to 10% of the latter. This material is used to make a heat sealable fabric.

In *TAPPI*, 59, 98–100 (1976), H. Chu et al. disclose radiation-curable systems of a polyester fiberfill web and a radiation-curable binder, namely a polyester-based acrylourethane and an epoxidized unsaturated oil capped with acrylic groups.

H. W. Rauhut, *Adhesives Age*, 12 (12), 28–34 (1969), discloses the use of ultraviolet pre-irradiation to improve adhesion of polyethylene to itself or to other materials in the presence of suitable adhesives and photosensitizers.

In U.S. Pat. No. 3,121,070, H. W. Coover, Jr. et al. disclose a process for "tailoring" polypropylene by thermally degrading polymers such as polystyrene, polymethylmethacrylate, and polymethylenediethylmalonate in the presence of polypropylene, blocks of the former polymers becoming chemically attached to polypropylene chains with only a relatively small amount of monomer being formed in the process.

In U.S. Pat. No. 3,878,019, Chapman et al. disclose a process for producing a bonded non-woven web by forming a non-woven web of fibrous material, applying on the web a film-forming polymer containing a photosensitive group therein or adding thereto a compound containing a photosensitive group, subjecting discrete locations of the polymer-coated web to UV light to cause cross-polymerization of the polymer at the discrete locations to effect polymer bonding of the web at these locations, and removing unpolymerized polymer from the web.

In copending U.S. Ser. No. 793,656, filed May 9, 1977, now U.S. Pat. No. 4,148,987 issued Apr. 10, 1979, assigned to the same assignee to which the present application is assigned, Winey discloses monoethylenically unsaturated derivatives of substituted benzophenones and acetylphenones and linear addition copolymers thereof which crosslink on exposure to UV light.

The linear addition copolymers are useful as binders for non-woven fabrics including disposable diapers, the binder-impregnated fabrics being curable by UV light to render the product fabrics resistant to disintegration by water or solvent.

In copending, U.S. Ser. No. 966,422, filed Dec. 4, 1978, assigned to the same assignee to which the present application is assigned, Brodnyan et al. disclose a non-woven fabric, adapted for use as a diaper coverstock, consisting essentially of fibers, at least 50% by weight of the fibers being hydrophobic, and a binder. The binder is a water insoluble hydrophobic copolymer polymerized from 1–8% by weight of a monoethylenically unsaturated carboxylic acid, 50–75% by weight of a $C_4$–$C_8$ alkyl acrylate, and 20–49% by weight of methylmethacrylate, styrene, alpha-methylstyrene or a mixture thereof. The fibers are selected from the group of those produced from polyesters, polyolefins, other vinyl resin fibers and natural fibers. The copolymer-treated fibers are exposed to heat cure conditions, namely, 150° C. for 1.5 min, to effect cure of the binder, "cure" being described as "not normally accompanied by polymer crosslinking." Rather, the application discloses that processes which may be considered to occur in the curing step include wetting of the fibers by the binder and spreading of the binder so as to interlock the fibers.

In copending U.S. Ser. No. 020,689, filed Mar. 15, 1979 and in a copending continuation-in-part application thereof, U.S. Ser. No. 043,998, filed May 31, 1979, both of which are assigned to the same assignee to which the present application is assigned, entitled "Radiation-Curable Allyl Benzoylbenzoate Copolymers, Compositions and Products Thereof, and Methods of Making Them," there is disclosed a film of a linear, essentially uncrosslinked addition copolymer of allyl benzoylbenzoate or benzoyl ring-substituted derivatives thereof such as, for example, allyl-2-(4-methylbenzoyl)benzoate, and at least one other monoethylenically unsaturated monomer wherein the film is carried on or in a substrate adapted to be cured to a crosslinked condition on exposure to UV radiation. The application also discloses the use of the linear addition copolymers containing allyl benzoylbenzoate as binders for non-woven fabrics or webs.

SUMMARY OF THE INVENTION

It is an object of the present invention to provide a process for making a non-woven fabric which overcomes the deficiencies and difficulties heretofore known.

It is also an object of the present invention to provide as an article of manufacture, a non-woven fabric produced by the process of the present invention.

These and other objects as will become apparent are achieved in the present invention which comprises a process for making a non-woven fabric comprising:

a. providing a mass of fibers to form a web or mat, at least 50% by weight of the fibers being hydrophobic;

b. contacting with the fibers a water-insoluble hydrophobic binder comprising a polymer polymerized from a monomer mixture comprising at least one polymerizable mono-ethylenically unsaturated monomer selected from the group consisting of $C_2$–$C_{18}$ alkyl acrylates, $C_2$–$C_{18}$ alkyl methacrylates, vinyl aromatic compounds, vinyl halides, vinylidene halides, vinyl esters of saturated carboxylic acids, optionally a small amount of one or more polymerizable ethylenically unsaturated monocarboxylic or dicarboxylic acids sufficient to provide colloid stability to the binder in aqueous medium, esters of polymerizable ethylenically unsaturated mono-carboxylic acids other than those of acrylic and methacrylic acids and esters of ethylenically unsaturated dicarboxylic acids, acrylonitrile, methacrylonitrile, alpha-olefins, and diene monomers, the polymer having a molecular weight of from about 50,000 to 10,000,000 and a glass transition temperature of from about −60° C. to 40° C.;

c. drying the binder-containing mass of fibers at a temperature above the glass transition temperature of the polymer to effect fusion of the polymer and bonding of the mass of fibers thereby; and d. exposing the dried binder-containing mass of fibers to a source of radiation, wherein the radiation consists of ultraviolet or electron beam radiation, for a period of time sufficient to effect cure of the polymer by crosslinking chains of the polymer, thereby rendering the resulting non-woven fabric resistant to organic dry-cleaning solvents, to water, and to surfactant-containing laundering systems and increasing the wet-strength of the resulting non-woven fabric.

In another aspect, the invention comprises an article of manufacture produced by the process of the invention.

In accordance with the present invention, it has unexpectedly and surprisingly been discovered that polymeric binders which do not contain conventional polymerizable crosslinking agents or which do not contain unpolymerized ethylenic unsaturation, which binders have not heretofore been known to be usefully crosslinkable without detracting from the advantageous properties thereof on exposure to a source of radiation, especially to ultraviolet light, are curable to a crosslinked condition when applied to non-woven webs or mats derived from hydrophobic fibers. The process of the present invention produces cured non-woven fabrics characterized by the necessary wet-strength which is demonstrated as wet tensile strength and wash resistance of the fabric, which properties are further described hereinbelow.

The expression "cure" is used herein to describe the process steps which result in a crosslinking reaction in a polymer whereby chains of the polymer become attached to each other or to the non-woven fibrous substrate by chemical bonds upon exposure of the binder-containing or binder-impregnated substrate to a source of radiation.

The mass of fibers are present in the form of a so-called "non-woven" mat in which the fibers are distributed in a random or in a regular or uniform arrangement. The mat may be formed by any of the processes used in producing non-woven fabrics which are well-known in the art. The mat may be formed by "carding" when the fibers are of such a character, by virtue of length and flexibility, as to be amenable to the carding operation. The mat may also be in the form of a spunbonded sheet product such as is described by Robert A. A. Hentschel, "Spunbonded Sheet Products," *CHEMTECH,* 32 (January 1974). Further, the mat may be in the form of a spunlaced fabric such as can be prepared by the process described by R. J. Summers in U.S. Pat. No. 3,434,188. Carding is a preferred procedure for preparation of the mat used in the present invention. The web produced by the carding operation may be further subjected to a needling treatment to obtain greater strength at right angles to the surfaces of the web.

The fibers which are useful in forming the non-woven fabric of the present invention may comprise natural textile fibers such as jute, sisal, ramie, hemp, and cotton, as well as many synthetic organic textile fibers or filaments derived from rayon, cellulose esters such as cellulose acetate, and vinyl resins such as those of polyvinyl chloride, copolymers of vinyl chloride with vinyl acetate, vinylidene chloride or acrylonitrile containing a major proportion of vinyl chloride in the polymer molecule, polyacrylonitrile and copolymers of acrylonitrile with vinyl chloride, vinyl acetate, methacrylonitrile, vinyl pyridine, or with mixtures of such comonomers and containing a major proportion, from 75 to 95%, of acrylonitrile in the copolymer molecule, polymers and copolymers of olefins such as ethylene and propylene, condensation polymers such as polyamides or nylon types and polyesters such as ethylene glycol terephthalate polymers and the like. The fibers used may be those of a single composition or mixtures of various compositions in a given web. Preferably, the fibers are hydrophobic, such as those of polyester and polyolefin composition, and mixtures thereof. Most preferably, the fibers are those of polyolefin composition, especially polypropylene. A single thin web or a plurality of webs superimposed to constitute a mat may be used, depending upon the thickness required for the intended end use. In building up such a mat, alternate layers of carded webs may be disposed with the fiber orientation directions disposed at angles such as 60° or 90°, with respect to the intervening layers.

The length of the fibers is also important in producing the fabrics of the present invention. The length should usually be a minimum of about 20 mm in order to produce uniform webs in the carding operation. Preferably the length should be between 35 and 40 mm although fibers having a length of 50 mm or more are useful. Very short fibers, such as those 10 mm or less in length, are also useful particularly for wet laid webs. Generally, depending upon the nature of the fibers, the fibers should have a linear-density of about 0.17 mg/m (1.5 denier). Preferably the polyester fibers have a linear density of about 0.17 mg/m (1.5 denier). The polyolefin fibers preferably have a linear density in the range of 0.11 to 0.33 mg/m (1–3 denier), although other linear densities are also useful in some instances.

The hydrophobic fibers of the invention are fibers which exhibit very little uptake of water upon immersion in water or exposure to high humidity. This property is often measured by adsorption of water by a polymer film having a composition corresponding to that of the fiber or by the moisture regain or uptake of dehydrated fibers when held in an atmosphere of fixed relative humidity. Sources of such data are J. R. Scott and W. J. Roff, et al., *Handbook of Common Polymers,* CRC Press, Cleveland, Ohio, 1971; E. Sutermeister, *Chemistry of Pulp and Paper Making,* John Wiley & Sons, New York, 1941; and the periodical *Textile World,* McGraw-Hill Publications, Atlanta, Ga. The following table is abstracted from the 1978 Textile World Man-Made Fibers Chart, herein included by reference on page 51 et seq. of the August 1978 Textile World.

| Fiber | Moisture Regain (%/70° F./65% RH) |
|---|---|
| Polyethylene Terephthalate | 0.4 |

-continued

| Fiber | Moisture Regain |
|---|---|
| Nylon 6 | 2.8–5.0 |
| Nylon 66 | 4.0–4.5 |
| Viscose Rayon | 11–13 |
| Cellulose Acetate | 2.5–6.5 |
| Acrylic (AN) | 1.0–2.5 |
| Modacrylic | 2.5–3.0 |
| Polyethylene | negligible |
| Polypropylene | 0.01–0.1 |
| Aramid (Kelvar ®, Nomex ®-DuPont) | 4–7 |
| Teflon ® (DuPont) | 0 |
| Spandex (polyurethane) | ca. 1 |

Hydrophobic fibers are fibers wherein the moisture regain is less than 2.5% and preferably less than 1% of the fiber weight at 70° F. and 65% R.H. The non-woven fabric of the present invention comprises at least 50% by weight of such hydrophobic fibers. Preferably the fibers of the fabric of the present invention consists essentially of hydrophobic fibers. More preferably, the fiber content of the fabric of the present invention is entirely hydrophobic fibers, especially 100% polyester fibers, such as poly(ethylene terephthalate), and 100% polyolefin fibers such as polypropylene fibers. Most preferably, the fiber content of the fabric of the present invention is 100% polypropylene.

The water-insoluble polymeric binder of the present invention can be formulated as a polymer solution produced by well-known solution polymerization techniques or as an aqueous dispersion produced by well-known emulsion polymerization techniques wherein the monomer mixture comprises at least one polymerizable monoethylenically unsaturated monomer selected from the group consisting of $C_2$–$C_{18}$ alkyl acrylates, $C_2$–$C_{18}$ alkyl methacrylates, vinyl aromatic compounds, vinyl halides, vinylidene halides, vinyl esters of saturated carboxylic acids, a small amount of one or more polymerizable ethylenically unsaturated mono-carboxylic or dicarboxylic acids sufficient to provide colloid stability to the binder in aqueous medium, esters of polymerizable ethylenically unsaturated mono-carboxylic acids other than those of acrylic and methacrylic acids and esters of ethylenically unsaturated dicarboxylic acids, acrylonitrile, methacrylonitrile, alpha-olefins, and diene monomers, the polymer having a molecular weight of from about 50,000 to 10,000,000 and a glass transition temperature of from about −60° C. to 40° C. Preferably, the binder is polymerized from a monomer mixture, the monomers of which have an average water solubility of less than 15 kg/m$^3$. The term "average solubility" is used herein to mean the sum of the weight fraction of each monomer in the monomer mixture, excluding those which are infinitely water soluble, multiplied by the water solubility of that monomer at 20° C. Up to about 10% by weight of the monomer mixture can comprise a monomer having infinite water solubility. Lists of water solubilities of monomers representative of those useful in the invention are published as follows: (1) C. E. Schildknecht, Ed., "Polymerization Processes", John Wiley and Sons, New York, 1977, p. 151; and (2) J. W. H. Faber and W. F. Fowler, *J. Polymer Sci.* A-1, 8, 1781 (1970). Additional data on water solubility of monomers can be found in the Encyclopedia of Polymer Science and Technology, Interscience Publishers, N.Y., in the various sections relating to particular monomers. Preferably the polymeric binder used in the present invention is polymerized from monomers that undergo crosslinking rather than scission or degradation on exposure to a source of radiation. Lists of crosslinking and degrading monomers are set forth in A. Chapiro, "Radiation Chemistry of Polymeric Systems", Interscience, New York 1962, p. 353. For example, acrylates and styrene are described as crosslinking monomers whereas methacrylates are described as degrading monomers. Generally, monomers that introduce tetrasubstituted carbons in the polymer backbone are described as degrading monomers. The average water solubility of the polymer should be less than about 8 $kg/m^3$ when degrading monomers are used. The monomers may be selected to provide a variable degree of hardness and flexibility in the binder so as to impart a corresponding softness or hardness, i.e., variable flexibility, to the bonded fibrous product. As is set forth above, the polymers useful as the binder in the present invention have a glass transition temperature, $T_g$, of from about −60° C. to 40° C., preferably from about −30° C. to 10° C.

The $T_g$ value can be found by plotting the modulus of rigidity against temperature; the $T_g$ can be taken as the temperature at which the modulus first falls appreciably below the line established in the glassy region as the temperature rises. A convenient method for determining modulus of rigidity and transition temperature is described by I. Williamson, *British Plastics*, 23, 87–90, 102 (September, 1950). A convenient method of calculating the $T_g$, based upon the $T_g$ of homopolymers of individual monomers, is described by Fox, *Bull. Am. Physics. Soc.*, 1, 3, page 123 (1956). Tables of the $T_g$ of the homopolymers are widely available and include the one in "Polymer Handbook" Section III, part 2, by W. A. Lee and R. A. Rutherford. Monomers may be selected to obtain the appropriate $T_g$ through use of the "Rohm and Haas Acrylic Glass Temperature Analyzer", publication CM-24 4/76 of Rohm and Haas Company, Philadelphia, Pa.

Preferably, the hydrophobic binder used in the present invention is provided as an aqueous dispersion of an emulsion polymer, the dispersion containing from about 5% to 60% by weight of polymer solids, polymerized from at least one polymerizable mono-ethylenically unsaturated monomer selected from the group consisting of $C_2$–$C_{18}$ alkyl acrylates, $C_2$–$C_{18}$ alkyl methacrylates, vinyl aromatic compounds, vinyl halides, vinylidene halides, vinyl esters of saturated carboxylic acids, polymerizable ethylenically unsaturated mono-carboxylic and dicarboxylic acids and esters thereof, acrylonitrile, methacrylonitrile, alpha-olefins, and diene monomers.

Examples of the $C_2$–$C_{18}$ alkyl groups of the esters of acrylic and methacrylic acids which are useful in forming the polymeric binders useful in the invention include ethyl, n-butyl, i-butyl, sec-butyl, t-butyl, the various isomeric pentyl, hexyl, heptyl, and octyl (especially 2-ethylhexyl), isoformyl, lauryl, cetyl, stearyl and like groups. Examples of vinyl aromatic compounds useful in forming the binder useful in the present invention include styrene and derivatives thereof such as vinyl toluene and alpha-methyl styrene. Exemplary of vinyl and vinylidene halides are the corresponding chloride compounds. Examples of vinyl esters of saturated carboxylic acids include vinyl acetate and vinyl propionate. Examples of polymerizable ethylenically unsaturated mono-carboxylic and dicarboxylic acids include acrylic acid, methacrylic acid, itaconic acid and crotonic acid. Examples of alpha-olefins which can be used in forming the binder include ethylene, propylene, butylene, and the like. Exemplary of diene monomers which can be used in the binder are butadiene and chloroprene.

In a preferred embodiment, the binder of the present invention is an emulsion polymer selected from the group of polymers polymerized from (1) a monomer mixture comprising from about 30–99.5% of at least one $C_4$–$C_9$ alkyl acrylate; from about 0–8% of at least one member selected from the group consisting of acrylic acid, methacrylic acid, itaconic acid and crotonic acid; and from about 0.5–65% of at least one member selected from the group of styrene and vinyl toluene, and (2) a monomer mixture comprising from about 25–70% of at least one diene monomer selected from the group consisting of butadiene and chloroprene; from about 0–8% of at least one member selected from the group consisting of acrylic acid, methacrylic acid, itaconic acid, and crotonic acid; and from about 30–75% of at least one member selected from the group consisting of styrene, vinyltoluene, and acrylonitrile, wherein the polymer has a $T_g$ of −30° C. to 10° C., and the mass of fibers is selected from the group consisting of a mass of at least 50% polyester fibers and a mass of at least 50% polypropylene fibers.

More preferably, the binder of the present invention comprises an emulsion polymer selected from the group of polymers polymerized from (1) a monomer mixture comprising from about 40–95% of at least one member selected from the group consisting of butyl acrylate and 2-ethylhexyl acrylate; from about 0–5% of at least one member selected from the group consisting of acrylic acid and methacrylic acid; and from about 20–55% of styrene and (2) a monomer mixture comprising from about 35–55% of butadiene; from about 0–5% of at least one monomer selected from the group consisting of acrylic acid and methacrylic acid; and from about 65–45% of styrene, when the polymer has a $T_g$ of −30° C. to 10° C., and the mass of fibers comprises a mass of at least 50% polypropylene fibers.

Optionally, compounds containing both polymerizable ethylenically unsaturated and photosensitive groups may be used in the monomer mixture to provide binders according to the invention. Although, these compounds are merely optional and not required, their incorporation in the monomer mixture provides binders and products according to the invention which possess highly advantageous performance characteristics. Exemplary of such compounds are allyl benzoylbenzoate and derivatives thereof disclosed in assignee's above-mentioned copending Ser. No. 020,689 and the continuation-in-part application filed May 31, 1979, polymerizable derivatives of benzophenone and acetophenone disclosed in assignee's above-mentioned copending Ser. No. 793,656, now U.S. Pat. No. 4,148,987, and (meth)acryloxy-substituted acetophenones and benzophenones described in the above-mentioned U.S. Pat. Nos. 3,214,492; 3,429,852, and 3,574,617. When such compounds are used, they may be used in an amount of up to about 8% by weight, preferably about 3–5% by weight, based on monomer mixture. When such compounds are used as described above, it is preferred to use allyl benzoylbenzoate or derivatives thereof.

As is set forth above, the polymeric binder is preferably produced from monomers which are free of safety and toxicity problems which might arise if trace amounts of such monomers were left in the monomer mixture, the monomers to be avoided including, amides and substituted amides of for example, acrylic and methacrylic acids. Also to be avoided are components which can evolve formaldehyde on heating or by chemical reaction, particularly reversible chemical reactions; examples of this type of monomer include methylol acrylamide and methacrylamide, methoxymethyl acrylamide, and other formaldehyde or aminoplast adducts of ethylenically unsaturated compounds. Formaldehyde condensates in general are to be avoided, examples of which include the low molecular weight or monomeric reaction products of formaldehyde with urea, thiourea, biurets, triazines (e.g. melamine) and homologs or derivatives of these such as alcohol modified derivatives. It is to be understood that nitriles, for example acrylonitrile and methacrylonitrile, are to be avoided for certain uses of the binder of the invention, such as for diaper covercloths, but are also advantageous for certain other uses such as for inner linings for dry-cleanable clothing garments, furniture upholstery and automotive interiors to name but a few.

The emulsion polymer used as the binder in the present invention can be obtained by emulsion polymerization of the monomers described hereinabove. Procedures for emulsion polymerization are, as set forth above, well known in the art and include procedures such as those described in U.S. Pat. Nos. 2,754,280 and 2,795,564. The copolymer has an average molecular weight of about 50,000, preferably above 300,000, and can be as high as 10,000,000. More preferably, the average molecular weight is in the range between 500,000 and 2,000,000. A chain transfer agent, which would obtain a polymer having low molecular weight, is generally not used in the polymerization mixture since high molecular weight contributes to the excellent wet strength properties.

For certain applications, auxiliary agents which are conventional to use in the textile industry can be added to the aqueous binder dispersion. Examples are soluble and insoluble dyestuffs, optical brighteners, surface active substances such as emulsifiers, wetting agents, defoaming and foaming agents, thickening agents, such as alginates, cellulose or starch ethers or esters, stabilizers such as casein, polyvinyl alcohol or ammonium salts of polyacrylic acid, biocides, pigments, fillers, and the like. A preferred wetting agent for use with fibers other than polyolfeins is a nonionic surfactant having an HLB (hydrophile-lipophile balance) value between about 12 and 16, preferably between 13 and 14. The wetting agent preferred for use with polyolefin fibers is Zonyl FSN (DuPont), a nonionic fluorocarbon surfactant.

In order to produce the product nonwoven fabric of the present invention, it is merely necessary to expose the dried binder-impregnated mass of fibers to a source of radiation, the radiation consisting of ultraviolet (UV) light, i.e., radiation having a wave length of about 2,000 to 5,000 Angstrom units, and electron beam radiation, for a period of time sufficient to effect cure of the polymeric binder by crosslinking the chains of the polymer which, yet, will not result in any undesirable degradation of the polymer or substrate, the degradation being in the form of oxidation and chain scission of the polymer or substrate and being manifested by discoloration and a marked deterioration in the physical properties of the polymer or substrate and of the non-woven fabric bonded therewith. The use of UV radiation is preferred because of the convenience and practicability with which it can be used and especially because of the overall better product performance achieved therewith.

The binder of the present invention may be applied to the web of fibers by means well known in the art, such as by spraying, padding, and the like. The concentration of the binder in the polymer emulsion is normally from about 5% to about 60% and is preferably from about 10% to about 30%.

Although the non-woven fabric can contain a high amount, such as up to 400% by weight, of emulsion polymer on the weight of the fibers, a preferred range of about 10–80% by weight dry binder add-on, more preferably from about 25–60%, is obtained.

In the following examples which are illustrative of the invention, all parts and percentages are by weight and the temperatures are Celsius unless otherwise expressly noted. The following abbreviations are used:

| | |
|---|---|
| AA | acrylic acid |
| ABB | allyl o-benzoylbenzoate |
| AN | acrylonitrile |
| APS | Ammonium persulfate |
| BA | butyl acrylate |
| sec-BA | secondary butyl acrylate |
| Bd | butadiene |
| t-BHP | t-butyl hydroperoxide |
| BMA | n-butyl methacrylate |
| E | ethylene |
| EA | ethyl acrylate |
| EHA | 2-ethylhexyl acrylate |
| EMA | ethyl methacrylate |
| HEMA | hydroxyethyl methacrylate |
| IA | itaconic acid |
| IBMA | isobutyl methacrylate |
| IBOMA | isobornyl methacrylate |
| MAA | methacrylic acid |
| MMA | methyl methacrylate |
| MlAM | 9:1 molar mixture of N-methylolacrylamide and acrylamide |
| MlMAM | 1:1 molar mixture of N-methylolmethacrylamide and methacrylamide |
| MOA | 55:45 molar mixture of N-methylolacrylamide and acrylamide |
| SHS | sodium hydrosulfite |
| SLS | Sodium lauryl sulfate (28% active ingredient in water) |
| St | styrene |
| Tg | glass transition temperature |
| VAc | vinyl acetate |
| $VCl_2$ | vinylidene chloride |
| VT | vinyl toluene |

In EXAMPLES 1–6, emulsion polymers containing units from N-methylolacrylamide and acrylamide, such as are disclosed in U.S. Pat. No. 3,157,562, are prepared from monomer mixtures set forth below according to well-known emulsion polymerization methods as are described in U.S. Pat. Nos. 2,754,280 and 2,795,564:

EXAMPLE 1

96 EA/4 MOA.

EXAMPLE 2

65 EA/25.5 BA/4.5 AN/3.5 MlAM/1.5 IA.

EXAMPLE 3

65 VA/30 E/5 MOA.

EXAMPLE 4

66 $VCl_2$/30 BA/4 MOA.

EXAMPLE 5

96 EA/4 MlMAM.

EXAMPLE 6

58.5 BA/37.5 St/4 MOA.

EXAMPLE 7

58.5 BA/37.5 St/4 AA

A monomer emulsion of 840 g of deionized water, 15.4 g of SLS (28% active ingredient in water), 80 g of AA, 750 g of St, and 1180 g of BA is prepared.

To a 5-liter kettle is charged 1235 g of deionized water and 2.5 g of SLS and this flask charge is heated to 82° C. To this flask is then added a 100 g portion of the monomer emulsion described above and an initiator solution of 4 g of APS in 25 g of water to provide a seed charge and the resulting seed charge is heated with stirring for about 10 minutes.

A solution of 4 g of APS in 120 g of water is added to the remainder of the monomer emulsion.

To the seed charged flask, maintained at about 82°-86° C., is then gradually added over a 2 hour period the solution of the remainder of the monomer emulsion and added APS. After this addition is completed, the resulting mixture is maintained at about 82°-86° C. for about 15 minutes and then cooled to 55° C. A 10 g portion of a solution of 1% ferrous sulfate heptahydrate in water is added. Then a solution of 2.5 g of t-BHP in 10 g of deionized water is added and the resulting mixture is stirred for 5 minutes. Following this, there is added a solution of 1.5 g of SHS in 20 g of water. This t-BHP/SHS addition is repeated twice at 15 minute intervals. The resulting batch is then cooled to room temperature and filtered through cheesecloth. The properties of the resulting polymer are: solids, 45.8%; conversion, 98.7%; pH, 2.6; viscosity, 100 cps. (Brookfield Viscometer, Spindle #2 at 60 rpm.).

Proceeding as in Example 7 but using different monomer mixtures, the following emulsion polymers (Examples 8-38) are prepared:

EXAMPLE 8

66 BA/34 St.

EXAMPLE 9

66 BA/26 St/8 AA.

EXAMPLE 10

60 BA/38 St/2 IA.

EXAMPLE 11

60 BA/37 VT/3 AA.

EXAMPLE 12

39 EHA/57 St/4 AA.

EXAMPLE 13

58 EHA/38 St/4 AA.

EXAMPLE 14

85 sec-BA/11 St/4 AA.

EXAMPLE 15

85 sec-BA/6 St/5 ABB/4 AA.

EXAMPLE 16

59 BA/32 St/5 ABB/4 AA.

EXAMPLE 17

58.5 BA/22.5 St/10 VT/5 ABB/4 AA.

EXAMPLE 18

43 EHA/49 St/5 ABB/4 AA.

EXAMPLE 19

60 BA/40 MMA.

EXAMPLE 19A

80 EA/10 AN/5 ABB (contains 6% Triton X-405 nonionic surfactant).

EXAMPLE 20

58.5 BA/37.5 St/4 AA.

EXAMPLE 21

60 BA/37 MMA/3 AA.

EXAMPLE 22

EA (homopolymer)

EXAMPLE 23

91 EA/5 St/4 AA.

EXAMPLE 24

85 EA/6 St/5 ABB/4 AA

EXAMPLE 25

7 EA/30 St.

EXAMPLE 26

63.5 BA/32.5 AN/4 AA.

EXAMPLE 26A

64 BA/22 St/10 AN/4 AA.

EXAMPLE 26B

59 BA/22 St/10 AN/5 ABB/4 AA.

EXAMPLE 27

55 VAc/41 BA/4 AA.

EXAMPLE 28

50 VAc/41 BA/5 ABB/4 AA.

EXAMPLE 29

77 VAc/21 E/2 AA.

EXAMPLE 30

49 BA/47 EMA/4 AA.

EXAMPLE 31

57 BA/30 EMA/6 St/5 ABB/4 AA.

EXAMPLE 32

96 BMA/4 AA.

EXAMPLE 33

45 BA/40 BMA/6 St/5 ABB/4 AA.

EXAMPLE 34

48 BA/48 IBMA/4 AA.

EXAMPLE 35

48 BA/43 IBMA/5 ABB/4 AA.

EXAMPLE 36

56 BA/40 IBOMA/4 AA.

EXAMPLE 37

66 BA/25 IBOMA/5 ABB/4 AA.

EXAMPLE 38

63.5 BA/32.5 St/4 AA.

The following examples illustrate the advantages of the process of the invention wherein the binder in the binder-impregnated non-woven fabrics, namely polypropylene and polyester fabrics, is cured by exposure to radiation. $T_g$ of binders is estimated using the Fox method.

A polypropylene carded web (25 g/m$^2$ [0.75 oz/yd$^2$]), Marvess fiber (Phillips Fibers), 0.33 mg/m (3 denier) linear density, 38 mm length) is provided for use in the following examples (except as otherwise indicated in EXAMPLES 40 and 42).

Polyester carded webs (41 g/m$^2$ [1.2 oz/yd$^2$], Dacron 54 fiber (Dupont), 0.17 mg/m (1.5 denier) linear density, 38 mm length) is provided.

A rayon carded web (17 g/m$^2$ [0.50 oz/yd$^2$], stock rayon fiber, 0.17 mg/m (1.5 denier) linear density, 38 mm length) is provided.

Padding bath formulations are prepared by diluting with water the binder emulsions to obtain a bath containing about 9% solids binder emulsion.

The webs are supported between two layers of fiberglass scrim, saturated with the 9% solids bath solution described above, and passed through a Birch Brothers Padder at 1.9 mm/sec (7.6 yd/min) and 206 mPa (30 psi) gauge pressure. The scrim is removed and the web is dried at 60° C. for 15 minutes in a forced air oven. The conditions of applying the binder are selected to obtain an add-on in the range of about 35–50% by weight dry binder based on the weight of the fiber used. (Binder add-on is determined from the weight of the fabric before and after treatment as follows: % add-on=(final fabric weight−initial fabric weight)×100÷initial fabric weight.

For heat curing, the dry, binder-impregnated fabric is exposed to a forced air oven heated at about 107° C. for 2 minutes or at about 150° C. for 1.5 minutes.

For ultraviolet radiation curing, the dry binder-impregnated fabric is passed on a conveyor belt through an Ashdee (Ashdee Division of George Koch Sons, Inc., Evansville, Ind.) UV Curing Range having two 7.9 kwatt/m mercury vapor lamps. Each fabric is passed through six times at 229 mm/sec (45 ft/min), the time of exposure being 1.7 sec/pass.

For determination of wet tensile strength, the fabric is first tested under dry conditions, i.e., conditions of 21° C. and relative humidity (R.H.) of 65% and then under wet conditions, i.e., soaking for about 30–45 minutes in deionized water containing 0.05% Triton X-100 (nonionic surfactant used as wetting agent) at room temperature. The cut strip method described in ASTM-D 1117-69 is used wherein strips of fabric 25.4 mm wide are extended at a rate of 6.67%/sec to break in the cross machine direction using an Instron tester, 76 mm gauge length. For each evaluation, six samples are tested and the average and 95% confidence limits are calculated and these results are set forth in the following table.

As a measure of fabric water resistance, wet abrasion resistance, i.e., the ability of the web to withstand repeated wash cycles, is determined by repeated washing, together with 8 terrycloth towels for ballast, of 250 mm×230 mm samples of experimental treated fabrics in a Maytag home launderer at full cycle wash setting at "hot" (60° C.) water setting, and with ½ cup of Orvus ® (Proctor & Gamble) detergent added. At the end of each cycle, the fabric is examined for failure. Failure is defined as fragmentation of the fabric into two or more pieces or, alternatively, the point at which it becomes so entangled (and thus distorted) as to be judged unusable.

EXAMPLE 39

This example illustrates the performance of conventional binders, which have been used in the prior art for binding non-woven fabrics, as binders for polypropylene fabrics. The first two acrylic binders are typical of binders described in U.S. Pat. No. 3,157,562. The third binder is a typical ethylene/vinyl acetate non-woven fabric binder.

The performance of the bonded polypropylene nonwoven fabric is evaluated in terms of wet tensile strength and wash durability characteristics. A wet tensile strength of 3 N/m/g/m$^2$ and a wash durability (i.e., the ability to withstand repeated washing) of 5 wash cycles are assumed to constitute acceptable performance criteria. The data set forth in Table I which follows demonstrate that the conventional binders exemplified are ineffective as binders for polypropylene, even though these same binders are suitable for use with polyester and rayon nonwoven fabrics as illustrated elsewhere below.

TABLE I

Effect of Conventional Binders on Polypropylene Fabrics

| Binder Polymer | Cure | Add-on (%) | Tensile Strength (N/m) Dry | Tensile Strength (N/m) $H_2O$ | Wash Cycles Survived |
|---|---|---|---|---|---|
| Example 1 | 107° C./2 Min. | 51.0 | 47.3 ± 3.5 | 24.5 ± 1.1 | 1 |
| Example 1 | 107° C./2 Min. + UV | 63.4 | 80.6 ± 7.0 | 42.0 ± 7.0 | 0 |
| Example 2 | 107° C./2 Min. | 36.8 | 68.3 ± 5.3 | 24.5 ± 5.3 | 3 |
| Example 2 | 150° C./ 90 Sec.[a] | 29.2 | — | — | 3 |
| Example 2 | UV | 37.3 | 61.3 ± 5.3 | 28.0 ± 1.8 | 0 |
| Example 3 | 107° C./2 Min. | 38.4 | 43.8 ± 3.5 | 17.5 ± 1.8 | 0 |
| Example 3 | UV | 30.3 | 36.8 ± 1.8 | 12.3 ± 1.8 | 0 |

[a]Fabric mounted on pin frame to prevent shrinkage.

EXAMPLE 40

This example illustrates the performance of hydrophobic binders on polypropylene nonwoven fabrics. These binders are synthesized from hydrophobic monomers, i.e., monomers having a water solubility of 10 kg/m$^3$ or less (with the exception of a small proportion of acrylic acid comonomer added for achieving latex stability). The results set forth in Table II demonstrate that these binders produce, upon UV cure, polypropylene non-woven fabrics characterized by particularly good wet tensile strength and wash durability. Table II also shows that heat cure of the binder-impregnated fabrics is ineffective. Table II also demonstrates that, although binders prepared from a monomer mixture containing a photosensitive comonomer or that binder formulations containing a photosensitive compound provide cured polypropylene non-woven fabrics characterized by especially good performance, the presence of a photosensitive comonomer in the binder or a photosensitive compound in the binder formulation is not necessary in order to obtain improved performance of polypropylene non-woven fabrics upon exposure to UV cure conditions.

Small proportions of water soluble comonomer, such as acrylic acid, are used to improve latex stability. A comparison of EXAMPLE 9 in Table II and the fifth-appearing polymer in Table XII shows that nonwoven tensile strengths and wash durability are not as good with 8% copolymerized AA as with 4%. Thus, too high a proportion of water soluble monomer can seriously detract from performance.

TABLE II

Effect of Hydrophobic Binders on Polyproplyene Fabrics[a]

| Binder Polymer | Tg (°C.) | Cure | Add-On (%) | Tensile Strength (N/m) Dry | Tensile Strength (N/m) $H_2O$ | Wash Cycles Survived |
|---|---|---|---|---|---|---|
| Ex. 8 | −18 | 107° C./2 min | 42.7 | 142 ± 14 | 59.5 ± 5.3 | 0 |
| | | UV | 40.0 | 189 ± 4 | 112 ± 9 | 8 |
| Ex. 7 | −9 | 107° C./2 min | 38.6 | 198 ± 28 | 96.3 ± 10.5 | 1 |
| | | UV | 42.6 | 273 ± 16 | 189 ± 12 | 20 |
| Ex. 7 | −9 | 107° C./2 min | 32.1[b] | 121 ± 19 | 45.5 ± 3.5 | 0 |
| | | UV | 33.7[b] | 193 ± 18 | 149 ± 4 | 17 |
| Ex. 7[c] | −9 | UV | 35.5 | 256 ± 23 | 149 ± 5 | 19 |
| Ex. 7[d] | −9 | UV | 39.2 | 249 ± 11 | 179 ± 12 | 24 |
| Ex. 7[e] | −9 | UV | 42.8 | 284 ± 16 | 222 ± 11 | 27 |
| Ex. 7[f] | −9 | UV | 44.0 | 303 ± 25 | 212 ± 12 | 33 |
| Ex. 9 | −18 | 107° C./2 min | 45.9 | 208 ± 28 | 56.0 ± 8.8 | 0 |
| | | UV | 45.4 | 207 ± 14 | 105 ± 5 | 7 |
| Ex. 10 | | 107° C./2 min | 52.7 | 277 ± 19 | 78.8 ± 12.3 | 0 |
| | | UV | 51.9 | 287 ± 11 | 226 ± 9 | 16 |
| Ex. 11 | −12 | none | 44.2 | 207 ± 19 | 8.76 ± 1.75 | 0 |
| | | UV | 44.3 | 201 ± 11 | 110 ± 9 | 5 |
| Ex. 12 | −5 | none | 47.6 | 80.6 ± 17.5 | 19.3 ± 3.5 | 1 |
| | | UV | 43.5 | 149 ± 21 | 121 ± 11 | 8 |
| Ex. 13 | −33 | none | 42.8 | 184 ± 12 | 47.2 ± 3.5 | 0 |
| | | UV | 42.0 | 196 ± 11 | 133 ± 9 | 8 |
| Ex. 14 | −3 | 107° C./2 min | 47.5 | 219 ± 18 | 119 ± 12 | 0 |
| | | UV | 48.0 | 233 ± 12 | 162 ± 5 | 7 |
| Ex. 15 | — | 107° C./2 min | 50.3 | 191 ± 11 | 116 ± 9 | 0 |
| | | UV | 49.1 | 252 ± 18 | 200 ± 5 | 23 |
| Blend of 80 Parts Example 4 and 20 Parts Example 5 | 3g | 107° C./2 min | 31.8 | 50.8 ± 1.8 | 21.0 ± 3.5 | 0 |
| | | UV | 31.4 | 126 ± 11 | 109 ± 4 | 20 |
| Ex. 16 | — | 107° C./2 min | 41.7 | 193 ± 11 | 73.6 ± 5.3 | 0 |
| | | UV | 38.3 | 247 ± 18 | 205 ± 18 | 44 |
| Ex. 17 | — | UV | 40.0 | 194 ± 19 | 149 ± 23 | 36 |
| | | UV | 34.8 | 175 ± 18 | 175 ± 5 | 35 |
| | | UV-$N_2$ | 36.4 | 224 ± 21 | 170 ± 14 | 24 |
| | | UV | 44.9[h] | 377 ± 54 | 287 ± 18 | 57 |
| Ex. 18 | — | none | 30.7 | 175 ± 11 | 89.3 ± 5.3 | 3 |
| | | UV | 34.0 | 166 ± 14 | 187 ± 12 | 55 |
| Airflex® 4514 | — | 107° C./2 min | 41.2 | 133 ± 5 | 66.5 ± 3.5 | 0 |
| | | UV | 37.2 | 173 ± 11 | 117 ± 4 | 4 |

[a]Polypropylene carded web of fibers having a linear density of 0.33 mg/m (3.0 denier) except where otherwise noted.
[b]0.22 mg/m (2.0 denier) linear density, 40 mm (1.6 in) length, Jacob Varde A/S Danaklon® fiber, 22 g/m$^2$ (0.65 oz/yd$^2$) web.
[c]2% diethoxyacetophenone added
[d]5% diethoxyacetophenone added
[e]2% benzildimethylketal added
[f]5% benzildimethylketal added
[g]Torsional modulus measurement
[h]0.20 mg/m, 1.8 denier fiber
[i]A vinyl chloride/ethylene/amide polymer produced by Air Products and Chemicals, Inc.

EXAMPLE 41

This example illustrates the effect of binders produced from monomer mixtures containing hydrophilic monomers and methacrylate monomers on polypropylene fabrics. The results set forth in Table III below show that fabrics bonded by binders produced from monomer mixtures containing hydrophilic comonomers (MMA, EA, VAc, AN) and other methacrylate comonomers (e.g., IBMA) are characterized by less advantageous performance properties with respect to polypropylene fabrics bonded with binders produced from hydrophobic monomers as described in Example 40 above. Presumably, methacrylate-containing binders are less effective than acrylate binders on exposure to UV cure conditions because there is introduced into the binder polymer backbone chain tetra-substituted carbons which are prone to participate in chain scission rather than crosslinking on irradiation.

TABLE III

Effect of Binders of Hydrophilic Monomers and Methacrylate Monomers on Polypropylene Fabrics

| Binder Polymer | Tg (°C.) | Cure | Add-On (%) | Tensile Strength (N/m) Dry | Tensile Strength (N/m) $H_2O$ | Wash Cycles Survived |
|---|---|---|---|---|---|---|
| Ex. 19 | −10 | 107° C./2 min | 44.8 | 145 ± 23 | 54.3 ± 12.3 | 0 |
| | | UV | 45.0 | 154 ± 26 | 63.0 ± 14.0 | 0 |
| Ex. 21 | −12 | 107° C./2 min | 34.8 | 110 ± 9 | 40.3 ± 3.5 | 0 |
| | | UV | 38.5 | 98.1 ± 10.5 | 43.8 ± 3.5 | 0 |
| Ex. 22[a] | −22 | UV | 42.1 | 38.5 ± 7.0 | 15.8 ± 1.8 | 0 |
| Ex. 23 | −14 | 107° C./2 min | 43.7 | 130 ± 14 | 26.3 ± 3.5 | 0 |
| | | UV | 43.8 | 154 ± 5 | 49.0 ± 3.5 | 0 |
| Ex. 24 | | 107° C./2 min | 45.6 | 163 ± 9 | 21.0 ± 1.8 | 0 |
| | | UV | 36.5 | 140 ± 16 | 66.5 ± 8.8 | 4 |
| Ex. 25 | 5 | 107° C./2 min | 35.7 | 121 ± 6 | 31.5 ± 1.8 | 0 |
| | | UV | 31.3 | 121 ± 11 | 77.1 ± 3.5 | 1 |
| Ex. 26 | −16 | 107° C./2 min | 43.4 | 191 ± 26 | 59.5 ± 5.3 | 0 |
| | | UV | 42.6 | 165 ± 23 | 116 ± 7 | 0 |
| Ex. 26A | −16 | 107° C./2 min | 41.2 | 208 ± 12 | 38.5 ± 8.8 | 0 |
| | | UV | 39.7 | 224 ± 19 | 102 ± 12 | 5 |
| Ex. 27 | −10 | 107° C./2 min | 42.5 | 212 ± 7 | 23.0 ± 1.8 | 0 |
| | | UV | 42.4 | 205 ± 23 | 52.5 ± 1.8 | 0 |
| Ex. 28 | −22 | UV | 44.3 | 270 ± 25 | 119 ± 5 | 2 |
| Ex. 29 | 17 | 107° C./2 min | 47.4 | 96.3 ± 7.0 | nil | 0 |
| | | UV | 45.5 | 123 ± 5 | 12.2 ± 1.8 | 0 |
| Ex. 30 | −5 | 107° C./2 min | 43.2 | 145 ± 5 | 75.3 ± 3.5 | 0 |
| | | UV | 42.6 | 159 ± 7 | 59.5 ± 7.0 | 0 |
| Ex. 31 | | 107° C./2 min | 39.2 | 133 ± 5 | 50.8 ± 3.5 | 0 |
| | | UV | 39.3 | 170 ± 11 | 128 ± 5 | 11 |
| Ex. 32 | 23 | 107° C./2 min | 39.4 | 19.3 ± 3.5 | 21.0 ± 3.5 | 0 |
| | | UV | 38.9 | 52.5 ± 3.5 | 22.8 ± 1.8 | 0 |
| Ex. 33 | −9 | 107° C./2 min | 38.9 | 159 ± 16 | 63.0 ± 7.0 | 0 |
| | | UV | 39.1 | 147 ± 9 | 124 ± 7 | 10 |
| Ex. 34 | −9 | 107° C./2 min | 45.7 | 159 ± 37 | 77.1 ± 21.0 | 0 |
| | | UV | 44.5 | 144 ± 2 | 89.3 ± 5.3 | 1 |
| Ex. 35 | | UV | 35.0 | 149 ± 16 | 78.8 ± 14.0 | 4 |
| Ex. 36 | | 107° C./2 min | 45.1 | 235 ± 28 | 179 ± 11 | 2 |
| | | UV | 40.5 | 200 ± 14 | 161 ± 18 | 5 |
| Ex. 37 | | UV | 37.5 | 133 ± 19 | 80.6 ± 10.5 | 10 |

[a]10% benzophenone added.

EXAMPLE 42

This example illustrates the advantages of UV irradiating binder copolymers containing diene comonomers. These are effective because of the hydrophobicity of diene monomers and their propensity to crosslink on irradiation.

The results in Table IV indicate that tensile strength and wash durability are improved significantly by UV cure. Wet tensile strengths and wash durabilities with the nitrile rubbers are not as good as those with the styrene/butadiene copolymers or the Neoprene latex. This is probably a consequence of the hydrophilic acrylonitrile comonomer.

TABLE IV

Effect of Diene Copolymer Binders on Polypropylene Fabrics

| Binder Polymer | Cure | Add-On (%) | Tensile Strength (N/m) Dry | Tensile Strength (N/m) $H_2O$ | Wash Cycles Survived |
|---|---|---|---|---|---|
| Dow Latex 221 | 107° C./2 min | 35.6 | 49.0 ± 8.8 | 5.3 ± 0.7 | 0 |
| | UV | 34.4 | 158 ± 21 | 117 ± 5 | 26 |
| Pliolite T70 | 107° C./2 min | 51.1 | 222 ± 14 | 40.3 ± 14 | 1 |
| | UV | 53.9 | 303 ± 21 | 159 ± 32 | 15 |
| Amsco 4125 | 107° C./2 min | 52.3 | 84 ± 7 | 19.3 ± 1.8 | 0 |
| | UV | 50.2 | 123 ± 16 | 107 ± 19 | 16 |
| Neoprene Latex 101 | 107° C./2 min | 41.3[a] | 54.3 ± 5.3 | 1.8 ± 0.0 | 0 |
| | UV | 47.0[a] | 152 ± 12 | 152 ± 12 | 20 |
| Hycar 1872 × 6 | 107° C./2 min | 47.7 | 102 ± 25 | 40.3 ± 7.0 | 0 |
| | UV | 38.8 | 142 ± 5 | 75.3 ± 8.8 | 12 |
| Hycar 1571 | 107° C./2 min | 39.8 | 87.6 ± 5.3 | 21.0 ± 1.8 | 0 |
| | UV | 45.4 | 64.8 ± 5.3 | 43.8 ± 1.8 | 4 |

[a]0.20 mg/m (1.8 Den) Fiber, 17.17 g/m$^2$ (0.5 oz/yd$^2$) web

Dow Latex 221 = Carboxylated styrene/butadiene rubber (Dow Chemical Co.)

Pliolite T70 = Carboxylated styrene/butadiene rubber (Goodyear Tire and Rubber Co.), 65 St/35 Bd copolymer Amsco 4125 = Carboxylated styrene/butadiene rubber (Amsco Divn., Union Oil Co.), 45 St/55 Bd copolymer)

Neoprene Latex 101 = Carboxylated chloroprene (DuPont Co.)

Hycar 1872 × 6 = Carboxylated nitrile rubber, Tg = −22° C., essentially free of emulsifier and other water sensitive ingredients (B. F. Goodrich Co.)

Hycar 1571 = Carboxylated nitrile rubber, Tg = −12° C. (B. F. Goodrich Co.)

EXAMPLE 43

This example illustrates the effect of post-addition of surfactant or base to binder dispersion which is then used to bond polypropylene fabrics. The emulsion polymer is produced using 0.25% SLS. Typical anionic (Siponate DS-4) and nonionic (Triton X-405) surfactants used in emulsion polymerizations are post-added to the aqueous dispersion. Ammonia, which partially neutralizes carboxylic acid in the emulsion polymer, is also added. The data set forth in Table V show that tensile strength and wash durability are reduced by these additives. Thus, surfactants, bases, and other materials that increase the water sensitivity of the binder should be minimized or avoided, both in manufacture and preparation of baths for treating fabric.

TABLE V

Effect of Post Addition of Surfactant and Base to Binder[a] on Polypropylene Fabrics

| Bath Additive | Bath pH | Add-On (%) | Tensile Strength (N/m) Dry | Tensile Strength (N/m) $H_2O$ | Wash Cycles Survived |
|---|---|---|---|---|---|
| none | 4.2 | 47.4 | 275 ± 26 | 154 ± 14 | 12 |
| 1% Siponate DS-4[b] | 4.0 | 45.6 | 259 ± 18 | 142 ± 18 | 7 |
| 6% Triton X-405[c] | 4.1 | 44.5 | 170 ± 14 | 105 ± 18 | 4 |
| $NH_4OH$ | 7.0 | 44.1 | 193 ± 14 | 107 ± 7 | 5 |

[a]Binder = Example 38; Binder is UV irradiated on fabric.
[b]Sodium dodecyl benzene sulfonate, Alcolac, Inc.
[c]p-(1,1,3,3-tetramethylbutyl)phenoxypoly (40) oxyethylene glycol, Rohm and Haas Company.

EXAMPLE 44

This example illustrates the adverse effect of N-methylolacrylamide in binders for polypropylene non-woven fabrics upon exposure to UV cure conditions. The data set forth in Table VI below demonstrates that the polypropylene nonwoven fabric bonded by the binder polymer of Example 6 is characterized by less advantageous wash durability than the polypropylene non-woven fabric bonded by the binder polymer of Example 20. Also the wet tensile strength of the fabric containing the binder of Example 20 is higher than the wet tensile strength of the fabric containing the binder of Example 6. Therefore, although the binder polymer of Example 6 provides benefit when used as a heat-curable binder on rayon and polyester non-woven fabrics as described elsewhere below, it is of much less benefit when used to bond polypropylene fabrics to be cured under UV cure conditions.

TABLE VI

Effect of N-Methylol Acrylamide in Binder on Polypropylene Fabrics

| Binder Polymer | Cure | Add-on (%) | Tensile Strength (N/m) Dry | Tensile Strength (N/m) $H_2O$ | Wash Cycles Survived |
|---|---|---|---|---|---|
| Example 6 | UV | 32.1 | 159 ± 21 | 103 ± 7 | 8 |
| Example 6 | UV | 39.3 | 173 ± 5 | 102 ± 9 | 4 |
| Example 6 | 107° C./2 Min. | 38.3 | 117 ± 12 | 42.0 ± 1.8 | 1 |
| Example 20 | UV | 36.3 | 205 ± 12 | 142 ± 12 | 13 |
| Example 20 | 107° C./2 Min. | 38.6 | 198 ± 28 | 96.3 ± 10.5 | 1 |

EXAMPLE 45

This example illustrates the effect of pre-irridation of polypropylene non-woven fabrics. In this example, polypropylene non-woven fabrics are first exposed to UV radiation and then binder is applied and finally the binder impregnated fabric is cured under heat conditions. The data set forth in Table VII below demonstrate that pre-irridation is of no or, at best, only slight benefit compared to heat cure alone, and that, in view of the results set forth in Table VI above, pre-irridation is of insignificant benefit compared with post-irridation. A polypropylene fabric without binder, upon exposure to UV cure conditions, possessed no significant wet strength or wash durability.

TABLE VII

Effect of Pre-irradiation of Polypropylene Fabric vs. Post-Irradiation of Binder-Impregnated Polypropylene Fabrics

| Binder Polymer | Cure | Add-on (%) | Tensile Strength (N/m) Dry | Tensile Strength (N/m) $H_2O$ | Wash Cycles Survived |
|---|---|---|---|---|---|
| Example 20 | 107° C./2 Min. | 38.6 | 198 ± 28 | 96.3 ± 10.5 | 1 |
| Example 20 | UV-Preirradiate + 107° C./2 Min. | 38.6 | 187 ± 11 | 105 ± 9 | 2 |
| Example 6 | 107° C./2 Min. | 38.3 | 112 ± 12 | 42.0 ± 1.8 | 1 |
| Example 6 | UV-Preirradiate + 107° C./2 Min. | 41.6 | 142 ± 12 | 68.4 ± 8.8 | 3 |
| None | UV | | 1.75 ± 0.18 | nil | 0 |

EXAMPLE 46

This example illustrates the effects of various binders under various cure conditions when used to bond polyester fabrics. The results set forth in Table VIII below show that the heat curable conventional binder, Example 2, is effective when used to bond polyester whereas it is ineffective when used to bond polypropylene (see Table I above). The data set forth in Table VIII below demonstrate that the process of the invention, wherein the binder polymer of Examples 17 and 20 represent preferred embodiments, is effective when applied to polyester non-woven fabrics.

TABLE VIII

Effect of Various Binders Under Various Cure Conditions on Polyester[a] Fabrics

| Binder Polymer | Web Density ($g/m^2$) | Cure | Add-on (%) | Tensile Strength (N/m) Dry | Tensile Strength (N/m) $H_2O$ | Wash Cycles Survived |
|---|---|---|---|---|---|---|
| Example 2 | 41 | 107° C./2 Min. | 41.2 | 412 ± 67 | 210 ± 9 | 129 |
| Example 2 | 41 | 150° C./90 Sec. | 42.2 | 571 ± 63 | 303 ± 74 | 112 |
| Example 20 | 41 | 150° C./90 Sec. | 41.9 | 623 ± 89 | 161 ± 56 | 3 |

TABLE VIII-continued

| Binder Polymer | Web Density (g/m²) | Cure | Add-on (%) | Tensile Strength (N/m) Dry | Tensile Strength (N/m) $H_2O$ | Wash Cycles Survived |
|---|---|---|---|---|---|---|
| Effect of Various Binders Under Various Cure Conditions on Polyester[a] Fabrics | | | | | | |
| Example 20 | 41 | 150° C./90 Sec. + UV | 42.5 | 771 ± 40 | 275 ± 25 | 26 |
| Example 17 | 41 | 150° C./90 Sec. | 46.8 | 769 ± 37 | 87.6 ± 38.5 | 2 |
| Example 17 | 41 | UV | 42.6 | 758 ± 138 | 271 ± 25 | 36 |
| Example 2 | 24 | 150° C./22 Sec.[b] | 54 | 103 ± 14 | 161 ± 9 | 39 |
| Example 2 | 24 | 150° C./22 Sec.[b] + UV | 54 | 91.1 ± 8.8 | 138 ± 14 | 29 |
| Example 20 | 24 | 150° C./22 Sec.[b] | 54 | 228 ± 32 | 91.1 ± 5.3 | 15 |
| Example 20 | 24 | 150° C./22 Sec.[b] + UV | 54 | 275 ± 26 | 137 ± 19 | 38 |
| Example 21 | 24 | 150° C./22 Sec.[b] | 54 | 191 ± 19 | 91.1 ± 5.3 | 8 |
| Example 21 | 24 | 150° C./22 Sec.[b] + UV | 54 | 186 ± 4 | 121 ± 7 | 6 |

[a]Dacron® 54 (E. I. Du Pont de Nemours & Company)
[b]Dry and cure on steam cans in continuous pilot plant runs.

EXAMPLE 47

This example illustrates the relative effects of conventional binders and UV curable binders on rayon non-woven fabrics. The results set forth in Table IX below demonstrate that there is only slight, if any, benefit achieved when subjecting UV curable binder impregnated rayon fabrics to UV cure conditions versus heat cure conditions. The use of the conventional heat curable binder of Example 1 under heat cure conditions produced the rayon fabric having the best overall performance properties. Accordingly, although UV curable binders are effective for use on rayon non-woven fabrics, they are less advantageous than the use of conventional binders under heat cure conditions. These data are set forth in Table IX below.

TABLE IX

| Binder Polymer | Cure | Add-on (%) | Tensile Strength (N/m) Dry | Tensile Strength (N/m) $H_2O$ | Wash Cycles Survived |
|---|---|---|---|---|---|
| Effect of Various Binders Under Various Cure Conditions on Rayon Fabrics | | | | | |
| Example 1 | 107° C./2 Min. | 40.2 | 214 ± 21 | 98.1 ± 5.3 | 56 |
| Example 1 | UV | 78.7 | 131 ± 11 | 57.8 ± 5.3 | 2 |
| Example 1 | 107° C./2 Min. + UV | 43.7 | 130 ± 21 | 56.0 ± 10.5 | 2 |
| Example 17 | 150° C./90 Sec | 50.6 | 224 ± 12 | 68.3 ± 26.3 | 7 |
| Example 17 | UV | 54.6 | 268 ± 19 | 96.3 ± 3.5 | 9 |
| Example 24 | 150° C./90 Sec | 56.1 | 152 ± 33 | 36.8 ± 5.3 | 0 |
| Example 24 | UV | 44.0 | 152 ± 21 | 47.3 ± 8.8 | 2 |
| Example 21 | None | 45.1 | 235 ± 16 | 40.3 ± 8.8 | 0 |
| Example 21 | UV | 48.2 | 278 ± 93 | 38.5 ± 5.3 | 0 |
| Example 19A | 150° C./90 Sec | 38.7 | 158 ± 16 | 50.8 ± 10.5 | 1 |
| Example 19A | UV | 40.2 | 231 ± 16 | 89.3 ± 5.3 | 7 |
| Example 20 | none | 57.7 | 254 ± 60 | 15.8 ± 7.0 | 0 |
| + $NH_4OH$ | 107° C./2 min | 53.5 | 342 ± 33 | 17.5 ± 3.5 | 1 |
| to bath pH = 5.2 | 150° C./1.5 min | 54.5 | 352 ± 58 | 92.8 ± 15.8 | 5 |
| | UV | 53.1 | 342 ± 30 | 85.8 ± 15.9 | 13 |

EXAMPLE 48

This example illustrates the effect of varying time of exposure to UV irradiation. Polypropylene nonwoven fabrics are impregnated with 63.5 BA/32.5 St/4 AA copolymer (EXAMPLE 38) and UV irradiated as described hereinabove, the number of passes under the lamps being varied in order to vary the time of exposure.

The results in Table X show that wet tensile strength and wash durability increase with increasing exposure to UV radiation and then level off. It can also be seen that heat cure produces no significant improvement in these properties, whereas UV radiation produces substantial improvements.

TABLE X

| Number of Passes[b] | Add-on (%) | Tensile Strength (N/m) Dry | Tensile Strength (N/m) $H_2O$ | Wash Cycles Survived |
|---|---|---|---|---|
| Effect of UV Irradiation of Binder[a]-Impregnated Polypropylene Fabrics | | | | |
| 0 | 46.7 | 238 ± 18 | 75.3 ± 7.0 | 0 |
| 2 | 47.3 | 201 ± 11 | 110 ± 5 | 4 |
| 4 | 48.3 | 243 ± 12 | 124 ± 7 | 9 |
| 6 | 47.4 | 275 ± 26 | 154 ± 14 | 12 |
| 8 | 47.6 | 270 ± 9 | 165 ± 12 | 15 |
| 10 | 48.0 | 219 ± 4 | 151 ± 11 | 18 |
| 12 | 47.5 | 203 ± 14 | 135 ± 5 | 16 |
| 14 | 46.5 | 257 ± 12 | 147 ± 1 | 17 |
| 107° C./2 min (Heat Cure) | 47.9 | 236 ± 14 | 73.6 ± 7.0 | 0 |

[a]63.5 BA/32.5 St/4 AA Copolymer Binder = Example 38
[b]On each side of fabric.

EXAMPLE 49

This example illustrates the effect of electron beam irradiation of 63.5 BA/32.5 St/4 AA copolymer binder (Example 38) on polypropylene non-woven fabrics. Fabrics are padded and dried in the same manner as described previously for UV cure. They are irradiated using an "Electrocurtain" Processor, Model CB 200/30/20, Energy Sciences, Inc., Woburn, Mass., at various doses, 195 kV, 157 mm/sec (31 ft/min) line speed. Fabrics are irradicated in an atmosphere of nitrogen, except for one sample that is irradiated in air plus the ozone generated in the processor. Fabrics are subjected to half the total dose, turned over, and then subjected to the remainder. The dose reported in Table XI is the total dose applied to the surfaces of the fabric.

As shown in Table XI, wash durability and, to a lesser degree wet tensile strength, are improved by electron beam irradiation. However, high doses are necessary and results are not as good as those achieved with UV irradiation (see Table X).

TABLE XI

Effect of Electron Beam Irradiation of Binder-Impregnated Polypropylene Fabrics

| Beam Current (ma) | No. of Passes | Total Dose (Mrads) | Irradiation Atmosphere | Add-On (%) | Tensile Strength (n/m) Dry | Tensile Strength (n/m) $H_2O$ | Wash Cycles Survived |
|---|---|---|---|---|---|---|---|
| 0 | 0 | 0 | — | 46.7 | 238 ± 18 | 75.3 ± 7.0 | 0 |
| 2.5 | 2 | 5 | $N_2$ | 49.6 | 231 ± 12 | 73.6 ± 7.0 | 0 |
| 2.5 | 6 | 15 | $N_2$ | 47.2 | 217 ± 11 | 35.0 ± 5.3 | 1 |
| 11.25 | 4 | 45 | $N_2$ | 46.6 | 231 ± 16 | 68.3 ± 12.2 | 5 |
| 11.25 | 4 | 45 | Air + $O_3$ | 45.5 | 147 ± 11 | 91.1 ± 7.0 | 3 |
| 11.25 | 12 | 135 | $N_2$ | 46.7 | 142 ± 16 | 82.3 ± 5.3 | 2 |

[a]63.5 BA/32.5 St/4 AA copolymer Binder = Example 38

EXAMPLE 50

This example shows the effect of binder glass transition temperature on tensile strengths and wash durability. A series of binders prepared according to EXAMPLE 7 with varying ratio of BA to St, and hence Tg, is shown in Table XII. It is evident that there is an optimum Tg. If Tg is too low, the binder is too soft and too weak to be effective. If Tg is too high, film formation is poor, and the binder is again ineffective. Therefore, regardless of any beneficial effects accruing from the crosslinking vs. scission propensity or hydrophobicity of certain monomers, binder Tg must be in a certain range for satisfactory performance properties.

TABLE XII

Effect of Binder Tg on Properties of UV Cured Polypropylene Nonwovens

| Binder Polymer BA | St | AA | Tg (°C.) | Add-On (%) | Tensile Strength (N/m) Dry | Tensile Strength (N/m) $H_2O$ | Wash Cycles Survived |
|---|---|---|---|---|---|---|---|
| 96 | 0 | 4 | −50 | 44.0 | 40.3 ± 7.0 | 33.2 ± 5.3 | 0 |
| 85 | 11 | 4 | −40 | 43.1 | 73.6 ± 5.3 | 49.0 ± 5.3 | 2 |
| 75 | 21 | 4 | −29 | 47.6 | 124 ± 11 | 87.6 ± 8.8 | 4 |
| 70 | 26 | 4 | −23 | 48.5 | 184 ± 11 | 105 ± 9 | 9 |
| 66 | 30 | 4 | −18 | 43.8 | 215 ± 11 | 142 ± 16 | 11 |
| 63.5 | 32.5 | 4 | −15 | 47.4 | 275 ± 26 | 154 ± 14 | 12 |
| 58.5 | 37.5 | 4 | − 9 | 42.6 | 273 ± 16 | 189 ± 12 | 20 |
| 40 | 56 | 4 | 18 | 42.1 | 54.2 ± 7.0 | 56.0 ± 10.5 | 2 |
| 30 | 66 | 4 | 35 | 43.6 | 24.5 ± 1.8 | 22.8 ± 3.5 | 0 |

EXAMPLE 51

Dryclean Durability

This example illustrates the improvement in dryclean durability of bonded polypropylene fabrics that results from UV irradiation. Polypropylene webs are impregnated with three binders. The treated fabrics were drycleaned in a commercial dryclean machine. In (Speed Queen Model CD2F11) with perchloroethylene solvent (Dowper CS drycleaning fluid, Dow Chemical Co.). The results in Table XIII below demonstrate that UV irradiation improves dryclean durability. The improvement is more pronounced when acrylonitrile and allyl o-benzoylbenzoate are contained in the binder copolymer. Although acrylonitrile may be undesirable for certain fabric uses because of toxicity and safety limitations, a small amount is very beneficial to impart dryclean resistance in fabrics where the uses are not subject to the aforementioned limitations.

TABLE XIII

Effect of UV Irradiation on Dryclean Durability of Binder[a]-Impregnated Polypropylene Fabrics

| Binder Polymer | Cure | Add-On % | Dryclean Cycles Survived |
|---|---|---|---|
| Example 38 | 107° C./2 min | 45.5 | 0 |
| | UV | 45.5 | 1 |
| Example 26A | 107° C./2 min | 42.9 | 1 |
| | UV | 39.7 | 4 |
| Example 26B | 107° C./2 min | 46.1 | 2 |
| | UV | 46.1 | 14 |

What is claimed is:

1. A process for making a non-woven fabric comprising:

a. providing a mass of fibers associated in a random or regular pattern to form a web or mat, at least 50% by weight of the fibers being hydrophobic;

b. contacting with the fibers a hydrophobic binder, which does not contain conventional polymerizable crosslinking agents or unpolymerized ethylenic unsaturation and which does not contain a photosensitive group or compound, comprising a polymer polymerized from a monomer mixture comprising at least one polymerizable monoethylenically unsaturated monomer selected from the group consisting of $C_2$–$C_{18}$ alkyl acrylates, $C_2$–$C_{18}$ alkyl methacrylates, vinyl aromatic compounds, vinyl halides, vinylidene halides, vinyl esters of saturated carboxylic acids, polymerizable ethylenically unsaturated mono-carboxylic and dicarboxylic acids and esters thereof, acrylonitrile, methacrylonitrile, alpha-olefins, and diene monomers, the polymer having a molecular weight of from about 50,000 to 10,000,000 and a glass transition temperature of from about −60° C. to 40° C.;

c. drying the binder-containing mass of fibers at a temperature above the glass transition temperature of the polymer to effect fusion of the polymer and bonding of the mass of fibers thereby; and d. exposing the dried binder-containing mass of fibers to a source of radiation, wherein the radiation consists of ultraviolet radiation and electron beam radiation, for a period of time sufficient to effect cure of the polymer by crosslinking the polymer chains, thereby rendering the resulting non-woven fabric resistant to organic dry-cleaning solvents and laundering and increasing the wet strength of the resulting non-woven fabric.

2. The process of claim 1 wherein the hydrophobic fibers are selected from the group consisting of polyolefin and polyester fibers.

3. The process of claim 1 wherein the binder comprises an aqueous emulsion polymer, containing from about 5% to 60% by weight of resin solids, the amount of binder dispersion being about 10% to 80% by weight based on the amount of fiber and binder combined.

4. The process of claim 2 wherein the source of radiation to effect cure of the polymer consists of ultraviolet radiation.

5. The process of claim 2 or 4 wherein the binder comprises an aqueous dispersion of a hydrophobic binder comprising an emulsion polymer, containing from about 5% to 60% by weight of resin solids, the amount of binder dispersion being about 10% to 80% by weight based on the amount of fiber and binder combined.

6. The process of claim 5 wherein the binder comprises an emulsion polymer polymerized from a monomer mixture comprising (1) about 30–99.5% by weight of at least one $C_4$–$C_9$ alkyl acrylate;

(2) about 0–8% by weight of at least one member selected from the group of acrylic acid, methacrylic acid, itaconic acid and crotonic acid; and (3) about 0.5–65% by weight of at least one member selected from the group consisting of styrene and vinyl toluene, wherein the polymer has a glass transition temperature of from −30° C. to 10° C., and wherein the fibers are selected from the group consisting of a mass of at least 50% polyester fibers and a mass of at least 50% polypropylene fibers.

7. The process of claim 6 wherein the binder is polymerized from a monomer mixture of (1) about 40–95% by weight of at least one member selected from the group consisting of butyl acrylate and 2-ethylhexyl acrylate;

(2) about 0–5% by weight of at least one member selected from the group consisting of acrylic acid and methacrylic acid; and (3) about 20–55% by weight of at least one member selected from the group consisting of styrene wherein the fibers comprise a mass of at least 50% polypropylene fibers.

8. The process of claim 5 wherein the binder comprises an emulsion polymer polymerized from a monomer mixture comprising (1) about 25–70% by weight of at least one diene monomer selected from the group consisting of butadiene and chloroprene;

(2) about 0–8% by weight of at least one member selected from the group consisting of acrylic acid, methacrylic acid, itaconic acid, and crotonic acid; and (3) about 30–75% by weight of at least one member selected from the group consisting of styrene, vinyltoluene and acrylontrile, wherein the polymer has a glass transition temperature of from −30° C. to 10° C. and wherein the fibers are selected from the group consisting of a mass of at least 50% polyester fibers and a mass of at least 50% polypropylene fibers.

9. The process of claim 8 wherein the binder comprises an emulsion polymer polymerized from a monomer mixture comprising (1) about 35–55% by weight of butadiene;

(2) about 0–5% by weight of at least one monomer selected from the group consisting of acrylic acid and methacrylic acid; and (3) about 65–45% by weight of styrene, wherein the fibers comprise a mass of at least 50% polypropylene fibers.

10. An article of manufacture produced by the process of claim 1.

11. An article of manufacture produced by the process of claim 3.

12. An article of manufacture produced by the process of claim 5.

* * * * *